United States Patent [19]

Andersson et al.

[11] 4,243,892

[45] Jan. 6, 1981

[54] ENERGY-EFFICIENT FLUID MEDIUM PUMPING SYSTEM

[75] Inventors: Nils-Eric Andersson, Vesteras; Bengt Sinner, Vesteras, both of Sweden

[73] Assignee: ASEA Aktiebolag, Vesteras, Sweden

[21] Appl. No.: 73,195

[22] Filed: Sep. 7, 1979

[30] Foreign Application Priority Data

Sep. 11, 1978 [SE] Sweden ..... 7809513

[51] Int. Cl.[3] ..... H02P 9/04

[52] U.S. Cl. ..... 290/1 R; 290/52

[58] Field of Search ..... 290/4 A, 4 B, 4 C, 4 D, 290/54, 43; 417/291, 287, 286, 288, 323, 374; 415/500; 60/52

[56] References Cited

U.S. PATENT DOCUMENTS

| | | | |
|---|---|---|---|
| 1,988,163 | 1/1935 | Church | 103/97 |
| 3,091,929 | 6/1929 | Hipp | 60/52 |
| 3,891,860 | 6/1975 | Hutarew | 290/52 |

*Primary Examiner*—J. V. Truhe
*Assistant Examiner*—D. Rebsch
*Attorney, Agent, or Firm*—Watson, Cole, Grindle & Watson

[57] ABSTRACT

The inventive pumping system includes at least two parallel-working pumps or compressors, at least one of which is operable as either a pump or a turbine in one or both directions, its drive motor being also capable of operating as a generator so as to feed electrical power back into the electrical network to which it is connected when necessary. At high fluid flows all the pumps or turbines act as pumps to cause the fluid medium to flow in one direction, whereas as low fluid flows the normal-acting pump or compressor operates at a relatively high energy-efficient speed while the excess flowing fluid medium is caused to flow in a return fashion through the outer pumps or turbines such that they act as turbines and thus generate electrical energy for feeding back to the electrical network to which it is connected.

4 Claims, 4 Drawing Figures

ENERGY-EFFICIENT FLUID MEDIUM PUMPING SYSTEM

BACKGROUND OF THE INVENTION

1. Field of the Invention

The present invention relates to a system for pumping a fluid medium from a lower level to a higher level, or from a lower pressure to a higher pressure.

2. The Prior Art

Fluid medium is caused to flow from one point to another or from one state to another usually by the use of pumps operating at substantially constant speeds, and control of the flow is usually achieved by the use of throttle valves connected in series with the pumps. Sometimes the throttle valves are instead located in flow lines arranged to run parallel to the constant-speed pump (via by-pass lines), and sometimes the pumps connected in series with the throttle valves may be operated by variable-speed controlled motors. From an overall energy efficiency point of view, only the latter-mentioned system is really acceptable. However, even with the latter-mentioned system, the higher the static lifting height, the smaller the relative energy savings are obtainable because even in the case of low volume flows the required pump effect is substantial. This effect sometimes even exceeds the required effect needed when the pump is operating at its nominal working mode. For low flows and high pressure heights, this means that it is never possible to reduce to zero the volume flow without making special arrangements with regard to cooling of the pump.

The present invention is directed to a pumping system which helps to obviate the energy losses incurred with prior art pumping systems, as well as other problems associated therewith, especially when operating at low fluid flow conditions.

SUMMARY OF THE INVENTION

According to the present invention the pumping system includes at least two parallel-working pumps or compressors, at least one of which is designed to operate as either a pump or a turbine in one or both directions, its drive motor capable of operating also as a generator to feed power back into the electrical network to which it is connected. Thus, the prior art throttle valve located in a by-pass line to the regular-acting pump is, in effect, replaced with a pump which is capable of also feeding energy back into the electrical network from the pump shaft via a drive motor/drive generator and converter. The regular-acting pump may be either a variable-speed controlled pump or a substantially constant-speed pump.

Energy savings at low flows can be achieved because the very low efficiency of these pumps which accompanies low flows can be completely avoided due to the fact that it is possible to pump fluid medium around internally in the system and thus maintain a high flow rate through all of the pumps, i.e., the ultimate flow through each of the pumps is kept relatively high.

Although the total energy loss in a pumping system is the sum of the losses in all the pumps, because of the high flow which prevails in each pump according to the present invention, the overall loss will be lower than if a conventional system with a single pump delivers a low flow at a high pressure.

The invention will now be better understood by reference to the accompanying drawing and the following description.

DETAILED DESCRIPTION OF THE PREFERRED EMBODIMENT

Figure 1A:
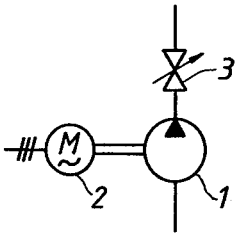
FIGS. 1A, 1B, and 1C schematically depict prior art pumping arrangements.
Figure 1B:
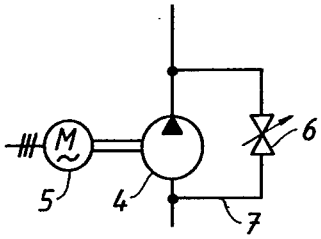
Figure 1C:
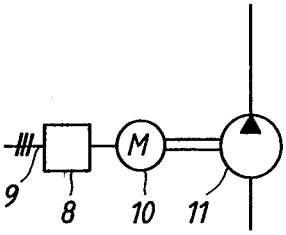

As shown in FIGS. 1A, 1B and 1C, typical prior art pumping systems for pumping a fluid medium from a lower level to a higher level may include a pump 1 which is driven by a constant-speed motor 2 (such as a three-phase asynchronous motor) so as to force the medium upwardly through a throttle valve 3 (FIG. 1A); or it may include a pump 4 which is driven with constant or substantially constant speed by a motor 5, a throttle valve 6 being positioned in a parallel (by-pass) line 7 (FIG. 1B); or it may include a pump 11 which is driven at a variable speed by a DC motor 10 which is itself driven by a thyristor convertor 8 supplied from an electrical network 9 (FIG. 1C). Although the latter embodiment shows a better energy economy than the former embodiments (e.g. the FIG. 1A embodiment displays a very low efficiency, as well as cooling problems), significant energy losses still occur when low flows are lifted to great heights.

Figure 2:
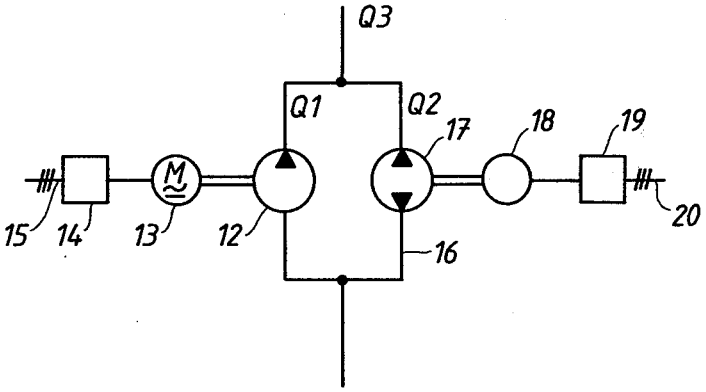
FIG. 2 schematically depicts an embodiment of a pumping arrangement according to the present invention.

As shown in FIG. 2, which depicts a pumping system in accordance with the present invention, a pump 12 is driven by a constant-speed or variable-speed controlled motor 13, which, in the former case, may be an asynchronous motor, and in the latter case, may be an asynchronous or DC motor, driven by the electric network 15 via a frequency convertor or rectifier 14. A parallel (by-pass) line 16 includes a second pump 17 which is driven by a variable-speed controlled drive system that includes a motor 18 and a frequency convertor or rectifier 19 connected to a network 20. The motor 18 may be, for example, a synchronous, an asynchronous, or a DC motor, which can also be driven as a generator in a known manner for feeding electrical energy back into the network 20. The number of pumps may be more than two, and they may, for example, be used in several by-pass lines.

To achieve full medium flow the pumps 12 and 17 pump in the same direction. With smaller flows, for example, at half flow (provided that constant pressure prevails), pump 17 is made inoperative so as to prevent medium from returning through by-pass line 16. When the flow is reduced any further, pump 17 is allowed to operate in a reverse direction so as to be driven as a turbine due to the downward liquid flow therethrough, and generates electrical energy for feeding into network 20.

It is estimated that the inventive pumping system provides for a reduction in electrical energy loss on the order of 30% for low medium flows.

While there has been shown and described what is considered to be a preferred embodiment of the present invention, it is obvious to those skilled in the art that various changes and modifications may be made therein without departing from the invention as defined in the appended claims.

We claim:

1. A system for pumping or compressing a fluid medium from a lower level to a higher level or from a fluid medium source at a lower pressure to a reservoir at a higher pressure which includes means forming a fluid medium input for carrying fluid medium from a lower level fluid medium source or from a fluid medium source at a lower pressure, means forming a fluid medium output for conveying the fluid medium to a reservoir at a higher level or at a higher pressure, means forming at least two parallel fluid medium flowpaths between said fluid medium input means and said fluid medium output means, means forming a pump or compressor in one of said flowpath-forming means for pumping or compressing the fluid medium from said input means to said output means, and means operable as either a pump or a turbine in each of the remainder of said flowpath-forming means, and a means connected to each said pump or turbine means operable as either a drive motor or an electrical generator, such that when said means connected to said pump or turbine means is operated as a drive motor, the means operable as either a pump or a turbine will act as a pump and fluid medium will be pumped from said input means to said output means, whereas when fluid medium is allowed to return flow from said output means to said input means, said means operable as either a pump or a turbine will act as a turbine and said means operable as either a drive motor or an electrical generator will operate as an electrical generator and feed power to an electrical network.

2. The system as defined in claim 1 wherein said means forming a pump or compressor in one of said flowpath-forming means is driven by a constant-speed motor.

3. The system as defined in claim 1 wherein said means forming a pump or compressor in one of said flowpath-forming means is driven by a variable-speed controlled motor.

4. The system as defined in claim 1 wherein each said means connected to each said pump or turbine means to operate as either a drive motor or an electrical generator comprises a variable-speed controlled motor which is capable of operating as a generator.

* * * * *